United States Patent [19]

Conley et al.

[11] 4,171,835

[45] Oct. 23, 1979

[54] SLIDING WINDOW LOCK

[76] Inventors: Beecher E. Conley, 2569 Butano Dr., Sacramento, Calif. 95821; Thomas M. Palmer, 10114 Golden Meadow, Houston, Tex. 77064

[21] Appl. No.: 882,422

[22] Filed: Mar. 1, 1978

[51] Int. Cl.[2] ..... E05C 19/18; E05C 17/54; E05D 13/06

[52] U.S. Cl. ..... 292/288; 49/450; 292/343; 292/DIG. 46

[58] Field of Search ..... 292/288, 343, 258, DIG. 46, 292/DIG. 47; 49/449-451; 248/410

[56] References Cited

U.S. PATENT DOCUMENTS

| | | | |
|---|---|---|---|
| 825,013 | 7/1906 | Taylor | 292/288 |
| 1,759,707 | 5/1930 | Paddock | 292/288 |
| 2,194,641 | 3/1940 | Daniels | 292/288 |
| 2,196,726 | 4/1940 | Folsom | 292/288 X |
| 2,331,150 | 10/1943 | Whiting, Jr. | 292/343 X |
| 2,673,106 | 3/1954 | Nelson | 292/288 X |
| 3,640,559 | 2/1972 | Royer | 49/450 X |

*Primary Examiner*—Roy D. Frazier
*Assistant Examiner*—William E. Lyddane
*Attorney, Agent, or Firm*—Blair, Brown & Kreten

[57] ABSTRACT

Disclosed herein is a lock suitable for use with sliding type windows which are constrained to ride within trackways. The apparatus comprises a pair of links pivotally connected having tab portions to provide for manipulation of these two links relative to each other and a biasing apparatus which tends to retard the two links from assuming a position in which one link would substantially totally overlie the other link. Further, downwardly extending tabs provide the nesting area for opposed extremities of the biasing spring which is wrapped in a preferred embodiment around the pivoting juncture of the two links and these tabs ride in the trackway or channel of the sliding windows and provide a resistive reaction to unauthorized opening of the window to such an extent that the window can not be opened in the conventional manner.

4 Claims, 9 Drawing Figures

SLIDING WINDOW LOCK

BACKGROUND OF THE INVENTION

Security devices for sliding windows have existed for sometime, and those of which undersigned are aware include U.S. Pat. Nos. 110,985, Lugrin; 262,038, Hayhurst; and 2,417,656, Lyons. None of these patents disclose the scissor type of mechanism for operating a lock of this nature, and further none of them have the configuration of the appended drawings which allows this lock to be used in channels or trackways of various configurations.

In fact the most prevalent method in current use for providing locks on sliding glass windows or doors is a simple bar mechanism which extends the length of the trackway up to the closed door or window and this has been the traditional mechanism for keeping the door or window locked shut. It would be appreciated however that when the door is open, the bar is of suitable dimension to create a problem in storage and in fact presents a hazard of it actually breaking the glass pane by means of an unstable storage of the rod.

OBJECTS OF THE INVENTION

Accordingly, it is an object of this invention to provide a lock for a sliding type window which requires little space and is economical to manufacture. Further, an object of this invention contemplates providing a lock for sliding windows which is easy to store.

A further object of this invention contemplates providing a lock of the above described character which will tend to engage the trackway that it is disposed in more strongly when the window or door is being forced.

A further object of this invention contemplates providing a lock of the type above wherein the lock may serve as a partial stop to preclude total opening of the window or door by translating this lock mechanism slightly down the trackway.

These and other objects will be made manifest when coonsidering the following detailed specification and figures.

DESCRIPTION OF THE PREFERRED EMBODIMENTS

Figure 1:
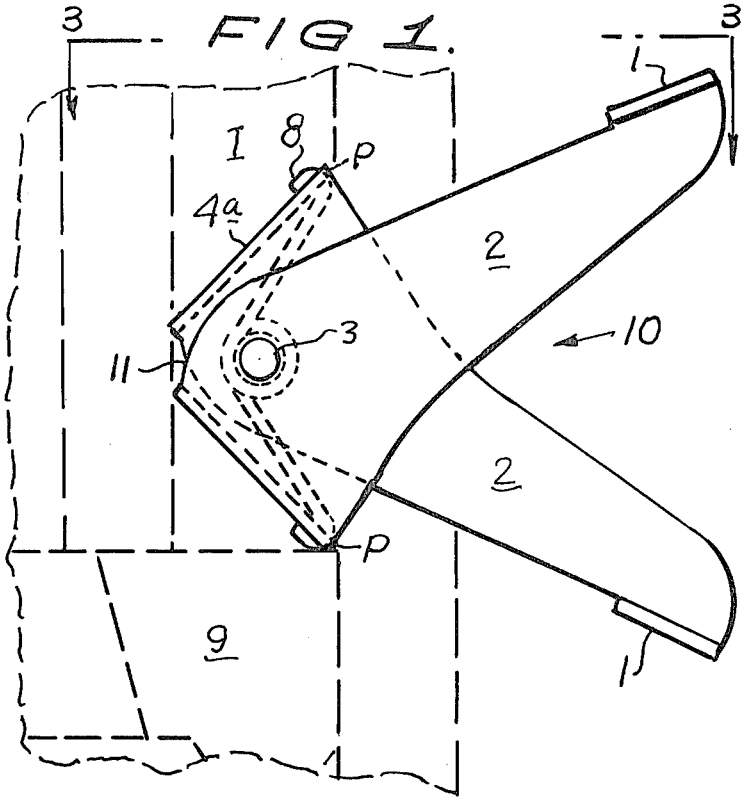
FIG. 1 shows a top plan view of one embodiment according to the present invention when it is disposed within a trackway.
Figure 2:
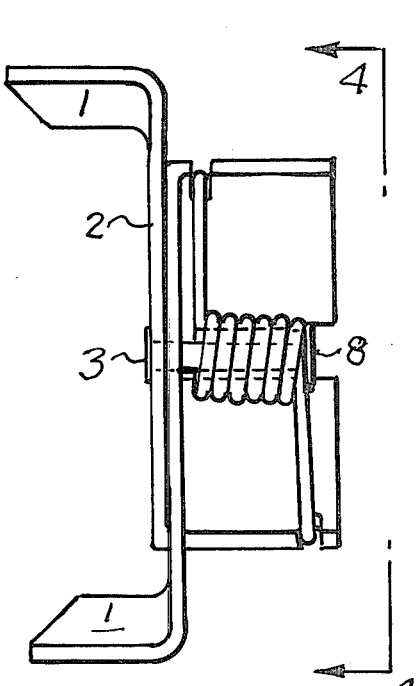
FIG. 2 is an end view thereof with the window structure deleted.
Figure 3:
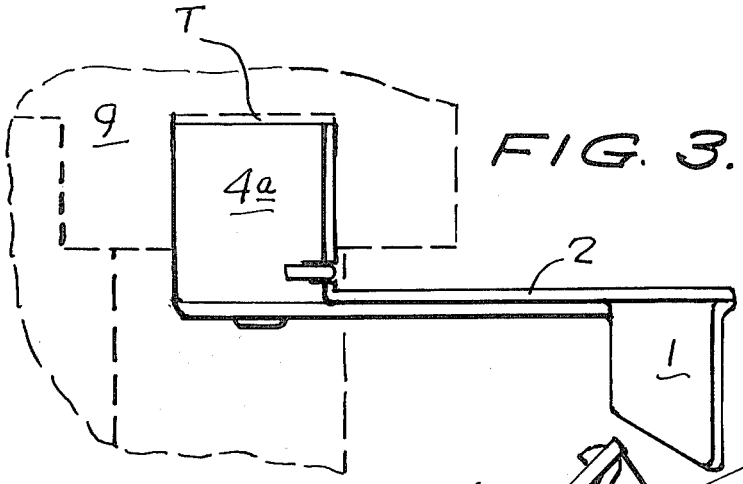
FIG. 3 is a side view taken along lines 3—3 of FIG. 1.

Referring to the drawings now wherein like reference numerals refer to like parts throughout the various drawings reference numeral 10 is generally directed to the apparatus according to the present invention, a lock.

Figure 4:
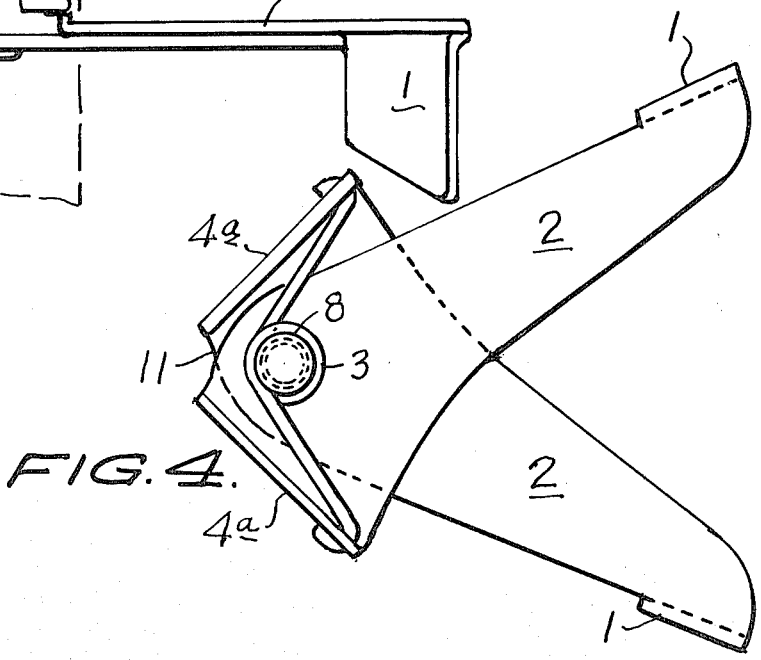
FIG. 4 is a bottom view taken along lines 4—4 of FIG. 2.
Figure 5:
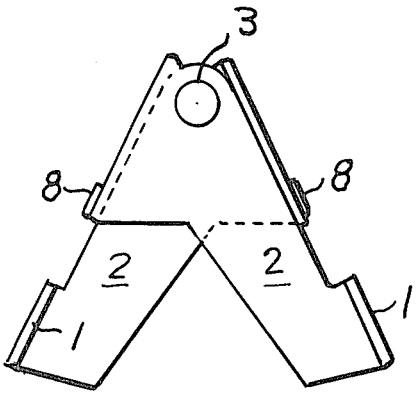
FIG. 5 is a top view of the structure seen in FIG. 6.
Figure 6:
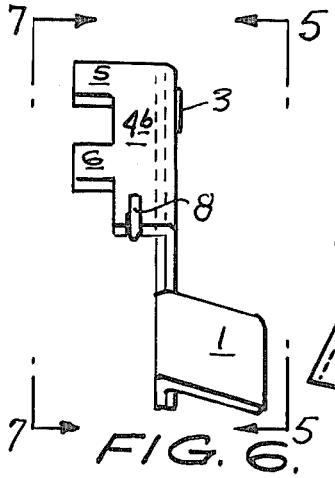
FIG. 6 is a side view of the alternative embodiment.
Figure 7:
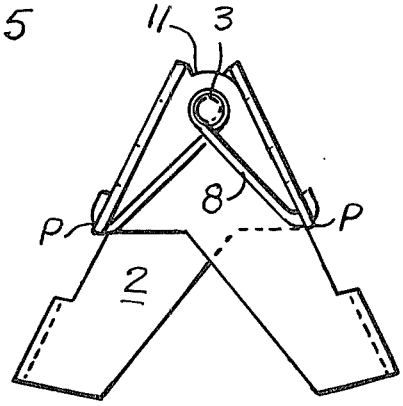
FIG. 7 is a bottom view taken along lines 7—7 of FIG. 6.
Figure 8:
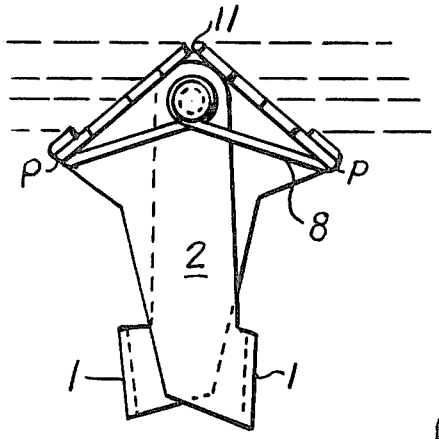
FIG. 8 is a bottom view of the structure in FIG. 7 in a tension condition.
Figure 9:
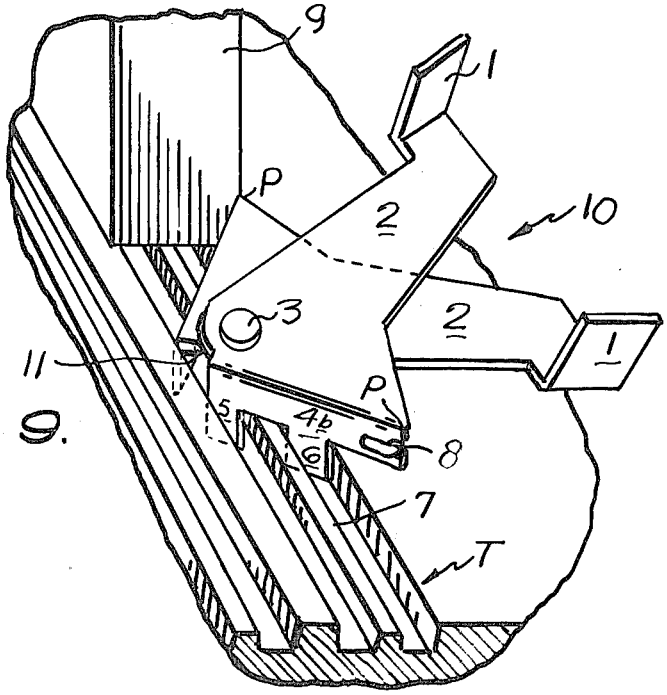
FIG. 9 shows a perspective view of the lock in its environment wherein a track is provided with a center channel.

The lock may generally be regarded as comprising a pair of links 2 pivoted together at one extremity as at 3 and crossing over each other so that the two links if they had been laid side by side and the points P on each link would be put in face to face relationship they would appear to be a mirror image of each other. Since the links are crossed over each other in a scissor like fashion, and in view of the fact that a biasing element 8 connects the two links at the extremity proximate to the pivot, a portion of the biasing spring 8 is wrapped around the pivot rivet. The rested natural state of this two bar linkage would be a somewhat X-shaped configuration (or an open scissor configuration) as best seen in FIGS. 1, 4 and 9. The links 2 have at their extremities remote from the pivot rivet 3 orthogonally upstanding handgrip members 1 and when looking downwardly upon the lock as for example in FIG. 8 or 7, the triangle formed by the characters P, 11, P form a substantially triangular shaped configuration in which the distance 11, P is the same on both sides, and further these edges denoted by 11, P have tab members (4*a* in FIGS. 1 through 4, and 4*b* in FIGS. 5 through 9) which extend downwardly and orthogonally relative to the links 2 and in the opposite direction or sense from handgrip members 1.

It is to be noted that the differences between the tabs 4*a* and 4*b* can best be summarized by noting that tab 4*a* is a substantially rectanguloid solid, while in FIG. 9 it can be seen that tab 4*b* has a medial cut away portion so that tangs 5 and 6 extend downwardly thereby defining a void between these two tangs. This void of course is present to accommodate a center channel 7 (FIG. 9) which is common in many of the trackways today T.

It is to be noted that when in the substantially untensioned state, the area denoted as 11 has a substantially rounded contour proximate to the pivot rivet 3, and when in the tension state (FIG. 8) the tab members 4*a* and *b* come close to touching at that point. FIGS. 1 and 9 show the significance of this cut away portion 11 since a sliding window or door 9 riding in a trackway T (irrespective of center channel 7 or not,) will first engage the window or door 9 at one point P. If force is applied to the door and therefore the lock, pressure on point P causes the edge proximate to 11 to dig into the channel and the reaction force based on the biasing spring as well as the tangential relationship of the other point P against the trackway causes the lock to increase its resistance to being opened in direct proportion to the amount of force applied to the door. In the case of the door or window that has a center channel 7, the frictional resistance is even greater when the downwardly extending tangs 5 and 6 are in tangential relation to the center channel or outer channels.

It is to be noted that the spring 8 wrapped around the pivot rivet 3 is symmetrical about that point and the leaves of the spring extend outwardly to the points P and are wrapped over a portion of the tabs 4*a* or 4*b*.

Having thus described the invention it will be apparent that many structural modifications are intended as being a part of this invention as explained hereinabove and as defined hereinbelow by the claims.

What is claimed is:

1. A lock for sliding closures which ride in a trackway comprising a pair of planar links pivotally connected and oriented in a scissorslike array, handgrip members orthogonally disposed to a plane of the links on the extremities of the links remote from the trackway, means on said links to urge said links in an open scissors type configuration, and means on said links to ride in a trackway of the sliding closure to frictionally constrain the sliding closure from motion including tab members connected to said links and orthogonally disposed relative thereto in a sense opposite from said handgrip members so as to ride in the trackway and provide edges which will ride against the walls of said trackway.

2. The device of claim 1 in which the means for urging the link in an open scissorlike fashion comprises a spring which is wrapped around said pivot and extends to said tab members.

3. The device of claim 2 in which a cut away substantially circular portion is provided on each link at the extremity remote from said handgrip members so that force on said lock will cause a point proximate to said cut away portion to engage the trackway yet said cut away portion allows said lock to be adjusted by said handgrips to accomodate trackways of varied dimensions.

4. The device of claim 3 in which said tab members define downwardly extending tangs having open areas between said tangs to accommodate a center groove in said channel.

* * * * *